US009011099B2

(12) United States Patent
Wortman et al.

(10) Patent No.: US 9,011,099 B2
(45) Date of Patent: Apr. 21, 2015

(54) HIGH VOLUME LOW SPEED FAN

(71) Applicant: SkyBlade Fan Company, Saint Clair Shores, MI (US)

(72) Inventors: John D. Wortman, St. Clair Shores, MI (US); Jonathon M. Jones, Flat Rock, MI (US); Ivan Russell, Saint Joseph, MO (US)

(73) Assignee: SkyBlade Fan Company, Saint Clair Shores, MI (US)

( * ) Notice: Subject to any disclaimer, the term of this patent is extended or adjusted under 35 U.S.C. 154(b) by 0 days.

(21) Appl. No.: 13/835,359

(22) Filed: Mar. 15, 2013

(65) Prior Publication Data

US 2013/0336790 A1 Dec. 19, 2013

Related U.S. Application Data

(60) Provisional application No. 61/661,619, filed on Jun. 19, 2012, provisional application No. 61/661,622, filed on Jun. 19, 2012.

(51) Int. Cl.

| | |
|---|---|
| ***F01D 5/14*** | (2006.01) |
| ***F04D 25/08*** | (2006.01) |
| ***F04D 29/34*** | (2006.01) |
| ***F04D 29/38*** | (2006.01) |

(52) U.S. Cl.

CPC ..... *F01D 5/141* (2013.01); *F04D 25/088* (2013.01); *F04D 29/34* (2013.01); *F04D 29/384* (2013.01)

(58) Field of Classification Search

USPC ..... 416/5, 210 R, 228, 238, 244 R

See application file for complete search history.

(56) References Cited

U.S. PATENT DOCUMENTS

| | | | |
|---|---|---|---|
| 6,589,016 | B2 | 7/2003 | Boyd et al. |
| 6,817,835 | B2 | 11/2004 | Boyd et al. |
| 6,939,108 | B2 | 9/2005 | Boyd |
| 7,252,478 | B2 | 8/2007 | Aynsley |
| 7,284,960 | B2 | 10/2007 | Aynsley |
| 7,292,154 | B1 | 11/2007 | Baier et al. |
| D587,799 | S | 3/2009 | Oleson |
| D607,988 | S | 1/2010 | Oleson et al. |
| 7,654,798 | B2 | 2/2010 | Aynsley |
| 7,726,945 | B2 | 6/2010 | Grant et al. |
| D631,536 | S | 1/2011 | Wiegel et al. |
| D635,237 | S | 3/2011 | Fizer |
| 7,934,907 | B2 | 5/2011 | Aynsley et al. |
| 7,955,055 | B1 * | 6/2011 | Boyd et al. ..... 416/244 R |

(Continued)

OTHER PUBLICATIONS

"Who Needs a Humongous Fan?" accessed on Oct. 30, 2013 using Internet <URL:http://www.humongousfan.com>.

(Continued)

*Primary Examiner* — Edward Look
*Assistant Examiner* — Maxime Adjagbe
(74) *Attorney, Agent, or Firm* — Howard & Howard Attorneys PLLC

(57) ABSTRACT

An HVLS fan system uses STOL technology for airfoils and angle of attack thus optimizing air movement efficiency and reducing drag. The HVLS fan system includes wingtip fence end caps to the airfoils for improving efficiency by reducing drag. The HVLS fan system also includes an interconnection of the airfoils to a securing plate thus providing a failsafe and reduced potential for damage or injury resulting from failure of the connection between the airfoil array and a drive unit such as an electric motor and associated gearing.

10 Claims, 7 Drawing Sheets

(56) References Cited

U.S. PATENT DOCUMENTS

| | | | | |
|---|---|---|---|---|
| D641,075 | S | 7/2011 | Fizer et al. | |
| D642,674 | S | 8/2011 | Oleson | |
| 8,075,273 | B2 | 12/2011 | Aynsley | |
| 8,079,823 | B2 | 12/2011 | Aynsley | |
| 8,123,479 | B2 | 2/2012 | Klemo et al. | |
| 8,142,156 | B2 | 3/2012 | Wiegel et al. | |
| 8,147,182 | B2 | 4/2012 | Aynsley et al. | |
| 8,147,204 | B2 | 4/2012 | Scherer et al. | |
| 8,152,453 | B2 | 4/2012 | Oleson | |
| 8,162,613 | B2 | 4/2012 | Oleson et al. | |
| D672,868 | S | 12/2012 | Williams | |
| D690,409 | S | 9/2013 | Noble et al. | |
| 8,529,212 | B2 | 9/2013 | Smith et al. | |
| D692,120 | S | 10/2013 | Noble et al. | |
| 8,556,592 | B1 | 10/2013 | Boyd et al. | |
| 8,579,588 | B1 | 11/2013 | Boyd | |
| 2006/0018751 | A1* | 1/2006 | Aynsley | 415/220 |
| 2010/0104461 | A1* | 4/2010 | Smith et al. | 417/423.1 |

OTHER PUBLICATIONS

"Big Ass Fans" accessed on Oct. 30, 2013 using Internet <URL:http://www.bigassfans.com>.

"MacroAir" accessed on Oct. 30, 2013 using Internet <URL:http://macroairfans.com>.

"Kelley Entre Matic" accessed on Oct. 30, 2013 using Internet <URL:http://kelley.4frontes.com>.

"Serco Entre Matic" accessed on Oct. 30, 2013 using Internet <URL:http://serco.4frontes.com>.

"Envira-North Systems, Ltd." accessed on Oct. 30, 2013 using Internet <URL:http://www.enviranorth.com>.

"Swifter" accessed on Oct. 30, 2013 using Internet <URL:http://www.swifterfans.com>.

* cited by examiner

| EPPLER AIRFIOL | | | |
|---|---|---|---|
| Upper Surface | | Lower Surface | |
| X | Y | X | Y |
| 1 | 1 | 1 | 1 |
| 0.99651 | 0.00164 | 0.99624 | 0.00112 |
| 0.98691 | 0.00672 | 0.98499 | 0.00411 |
| 0.97277 | 0.01481 | 0.96642 | 0.00842 |
| 0.95489 | 0.02457 | 0.94082 | 0.01364 |
| 0.93297 | 0.03482 | 0.9085 | 0.0195 |
| 0.90643 | 0.04537 | 0.86982 | 0.0257 |
| 0.87539 | 0.05656 | 0.82517 | 0.0319 |
| 0.84038 | 0.0684 | 0.77511 | 0.03772 |
| 0.80194 | 0.08078 | 0.72022 | 0.04282 |
| 0.76066 | 0.09349 | 0.66118 | 0.04673 |
| 0.71712 | 0.1063 | 0.59891 | 0.04891 |
| 0.67193 | 0.11894 | 0.53466 | 0.04901 |
| 0.62569 | 0.13108 | 0.46958 | 0.04702 |
| 0.57896 | 0.14238 | 0.40568 | 0.04271 |
| 0.53229 | 0.15251 | 0.34148 | 0.03569 |
| 0.48619 | 0.1161 | 0.28199 | 0.02637 |
| 0.44113 | 0.16779 | 0.22769 | 0.01593 |
| 0.39754 | 0.17213 | 0.17938 | 0.00565 |
| 0.35549 | 0.1736 | 0.13725 | -0.00317 |
| 0.31479 | 0.17212 | 0.10095 | -0.00982 |
| 0.27549 | 0.16792 | 0.07024 | -0.01411 |
| 0.23772 | 0.16127 | 0.04499 | -0.01596 |
| 0.20171 | 0.15253 | 0.02516 | -0.01545 |
| 0.16784 | 0.14201 | 0.01354 | -0.01354 |
| 0.13642 | 0.12998 | 0.00994 | -0.01249 |
| 0.10776 | 0.11669 | 0.00786 | -0.01169 |
| 0.08212 | 0.1024 | 0.00604 | -0.01082 |
| 0.05791 | 0.08739 | 0.00524 | -0.01034 |
| 0.04071 | 0.07196 | 0.00452 | -0.00984 |
| 0.02527 | 0.05643 | 0.00389 | -0.00931 |
| 0.01345 | 0.04116 | 0.00335 | -0.00871 |
| 0.00531 | 0.02654 | 0.00287 | -0.00803 |
| 0.00086 | 0.01305 | 0.00242 | -0.00731 |
| 0.00003 | 0.00128 | 0.00165 | -0.00571 |
| 0.00033 | -0.00107 | 0.00102 | -0.00396 |
| 0.00102 | -0.00396 | 0.00033 | -0.00107 |

FIG. 14

HIGH VOLUME LOW SPEED FAN

CROSS-REFERENCE TO RELATED APPLICATIONS

This application claims priority to two provisional patent Applications Nos. 61/661,619 and 61/661,622 filed on Jun. 19, 2012. The disclosure of the prior applications are incorporated herein by reference.

TECHNICAL FIELD

The invention generally relates to high volume low speed (HVLS) fans, and more specifically HVLS fans utilizing short take off and landing (STOL) technology.

BACKGROUND OF THE INVENTION

Interior climate control and air circulation is difficult in certain applications, particularly including large open structural areas such as found in a factory or warehouse setting. This difficulty is encountered in both hot and cold seasonal conditions, where heat during cold weather heating migrates towards the ceiling of a building and humidity tends to migrate down during hot and humid weather conditions. Therefore, there is an interest in forcing air from the ceiling, down, towards an occupied main floor during cooler weather, thus saving costs for heating, and circulating air more generally in warmer weather conditions resulting in a perceived cooler environment due to evaporation. Solutions to these conditions include forced ventilation through ceiling-based plenums in HVAC applications. Another solution is the use of ceiling fans to circulate the ambient air. However, both of these solutions are inadequate for circulating large volumes of air in large open areas such as is common in a factory or warehouse setting.

HVLS fans provide improvement over HVAC systems and/or traditional ceiling fans by moving larger volumes of air. These systems have their own limitations including relatively low efficiency in both the amount of energy used and amount of circulated air per unit of energy use.

STOL technology is a known solution for allowing aircraft to take off and land within constrained short distances. STOL technology has been adapted to aircraft airfoil profiles for providing improved lift and efficient movement of air under slower take off or landing speeds. Known aircraft wing profiles utilizing STOL design technology include EPPLER-420 and FX63-137 profiles. But, these airfoil profiles utilizing STOL design technology have not been adapted for use in HVLS fan systems.

In addition, due to their size and weight resulting from fans reaching diameters from 12 feet to 20 feet, or more, there is risk to persons and equipment below the fan in the event of a failure causing a portion, or all, of the fan to fall.

Therefore, there is opportunity and need for improving air circulation systems in large open areas. Further, there is need for improving HVLS fan systems to provide higher efficiencies and maximize airflow in large open spaces such as warehouses, manufacturing facilities, places of worship, gymnasiums/health clubs, auto dealerships and more. There is also a need for providing safety measures in the implementation of HVLS fan systems.

SUMMARY OF THE INVENTION AND ADVANTAGES

The present disclosure addresses these needs and issues by providing an HVLS fan system incorporating STOL technology in a system that increases air volume and circulation while also increasing efficiencies and which does not add significant costs, weight, or manufacturing complexity to this system.

It is therefore an object of the disclosure to take advantage of STOL technology and thus increase efficiency of an HVLS fan system. It is a further object of the disclosure to provide greater efficiency in the movement of air in the HVLS system. It is an additional object of the disclosure to provide an economical and lightweight solution to better circulate air in large areas. Another object of the disclosure is to provide a safety mechanism for preventing injury or damage in the event of a failure in the HVLS fan.

The present disclosure provides an HVLS fan system utilizing STOL technology and having better efficiency, including an airfoil form adapted to provide higher airflow at lower circulation rates while decreasing drag on the airfoils and increasing efficiencies. The system also includes an airfoil profile consistent with STOL technology. More particularly, an airfoil utilizing an EPPLER 420 or substantially similar airfoil design. In addition, the system includes a wing tip advantageously formed to reduce drag of the airfoil. Further, the system employs a hub displacing the airfoil at an angle most suitable for maximizing the benefits of the STOL technology. More particularly, this includes a hub providing an attachment angle of between seven and ten degrees to the airfoil, and even more particularly eight degrees to the airfoil. Together, the disclosure provides an HVLS fan system offering improved efficiency, reduced drag, and increased air flow for the benefit of better circulating air in a large open area.

In addition, the system includes a safety system including attachment of a retaining member, one for each airfoil, on the hub that passes through a retaining bracket in a manner that in the event of the airfoil becoming dislodged from the hub or the hub itself becoming disconnected from the drive system prevents the hub and/or the airfoils from falling. The retaining brackets do not touch or otherwise notably increase air resistance in the system but provide for an important safety measure where failure can cause catastrophic consequences. Another safety aspect is a series of overlapping brackets which mount on the top of the airfoils which interlock each of the airfoils to the one next to it. This will prevent an airfoil from becoming dislodged from the system in the case of failure. In addition, guy wires connect the frame of the HVLS fan system to a support member such as a ceiling support beam.

Other objects and features of the present invention will become apparent when viewed in the light of the detailed description of the preferred embodiments when taken in conjunction with the attached drawings and the appended claims.

BRIEF DESCRIPTION OF THE DRAWINGS

The present invention will become more fully understood from the detailed description and the accompanying drawings, wherein:

FIG. 14 is a table containing X-Y data coordinates for the airfoil profile of the HVLS fan system.

DESCRIPTION OF THE PREFERRED EMBODIMENTS

Figure 1:
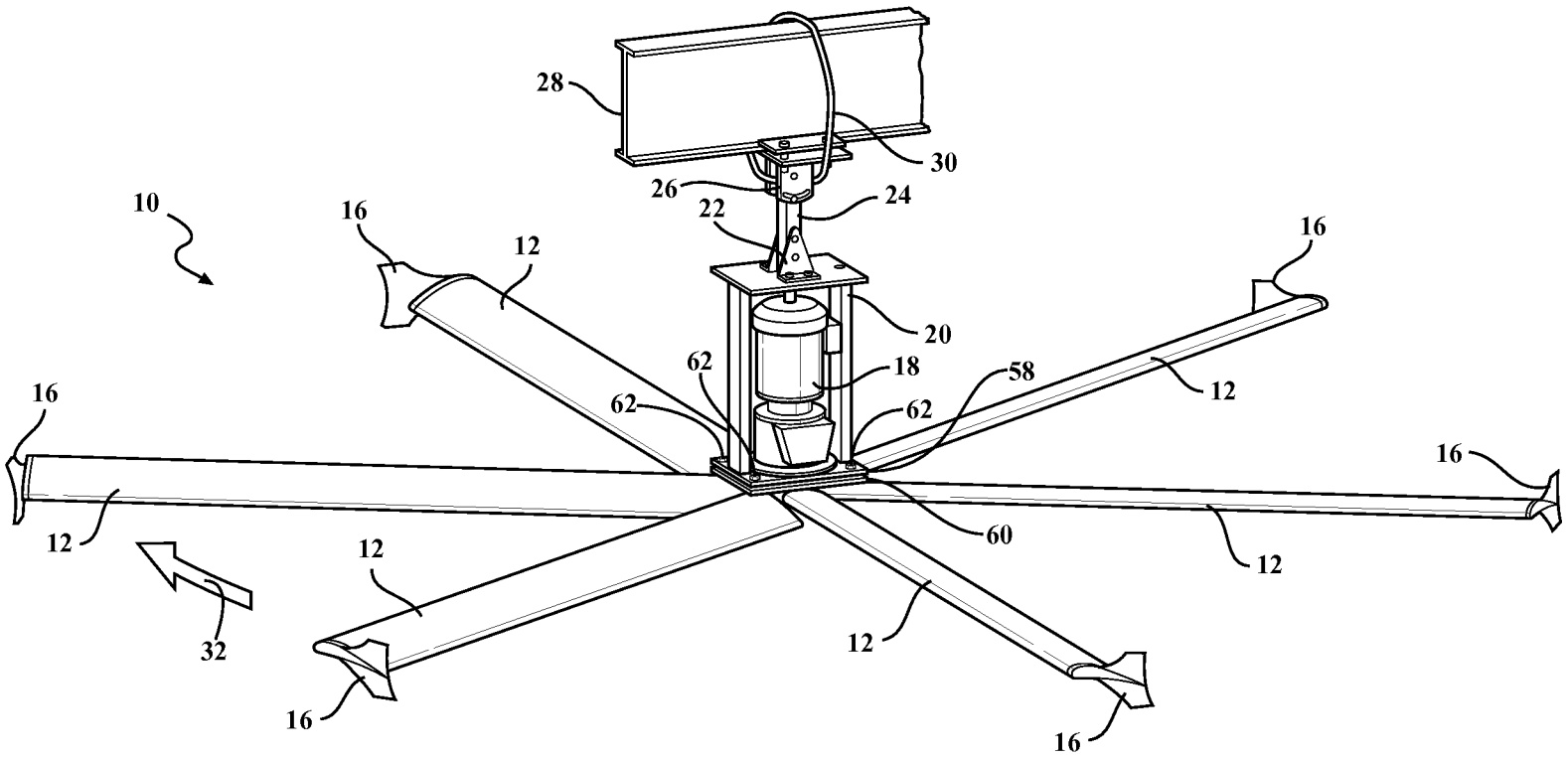
FIG. 1 is a perspective view of the HVLS fan system of the invention.

In the following figures, like reference numerals are used to identify identical components in the various views and embodiments. The following example is meant to be illustrative of preferred embodiments for the invention. However, those skilled in the art will recognize various additional alternative embodiments.

Figure 2:
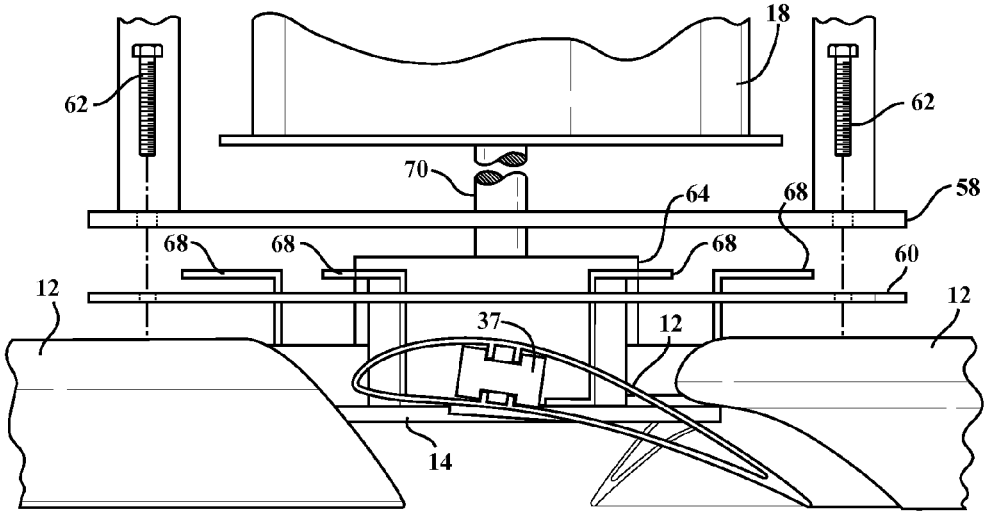
FIG. 2 is a side sectional view in spaced apart form showing the HVLS fan system of FIG. 1.
Figure 3:
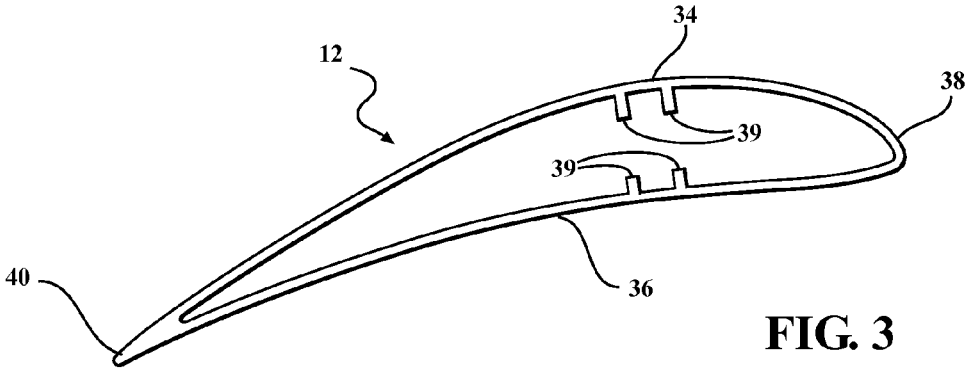
FIG. 3 is a side cross sectional view of an airfoil of the HVLS fan system.
Figure 4:
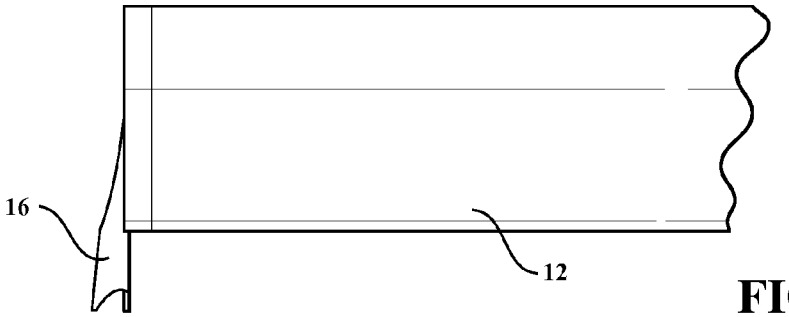
FIG. 4 is a top view of an airfoil of the HVLS fan system.
Figure 5:
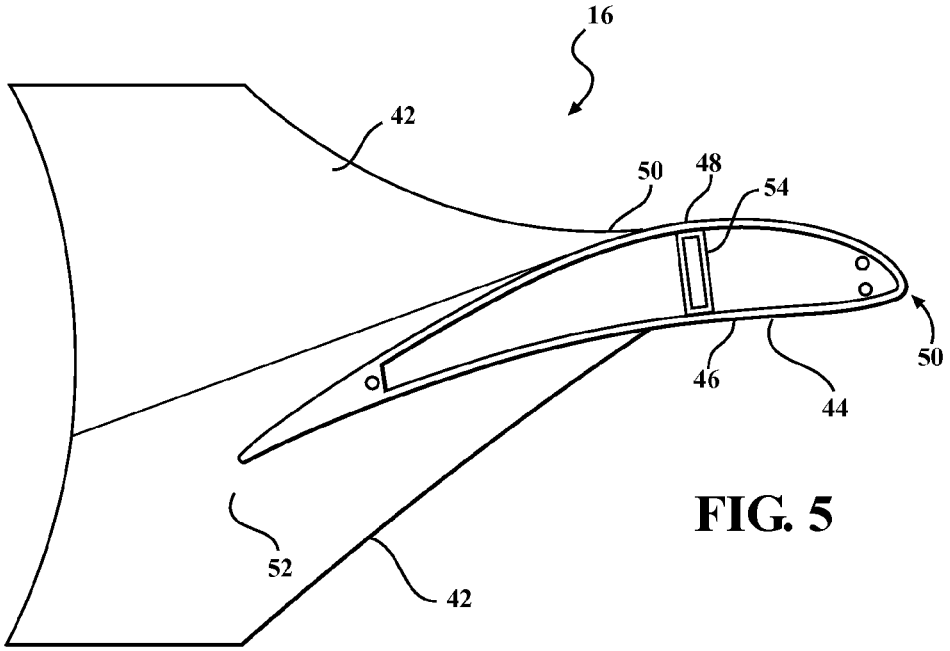
FIG. 5 is a side view of a wingtip fence of the HVLS fan system.
Figure 6:
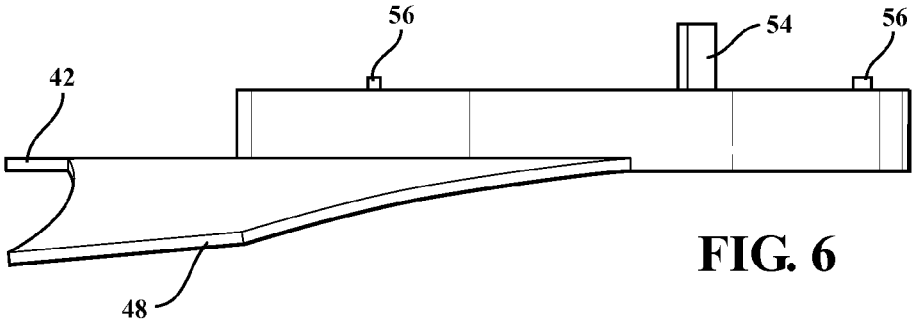
FIG. 6 is a top view of the wingtip fence of FIG. 5.
Figure 7:
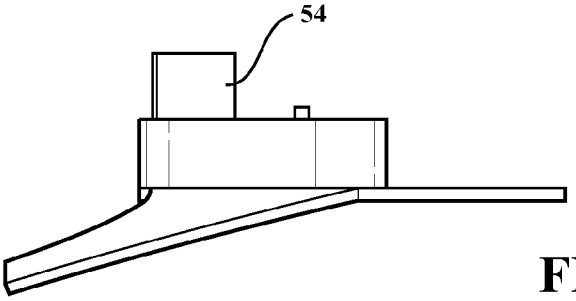
FIG. 7 is a back view of the wingtip fence of FIG. 5.
Figure 8:
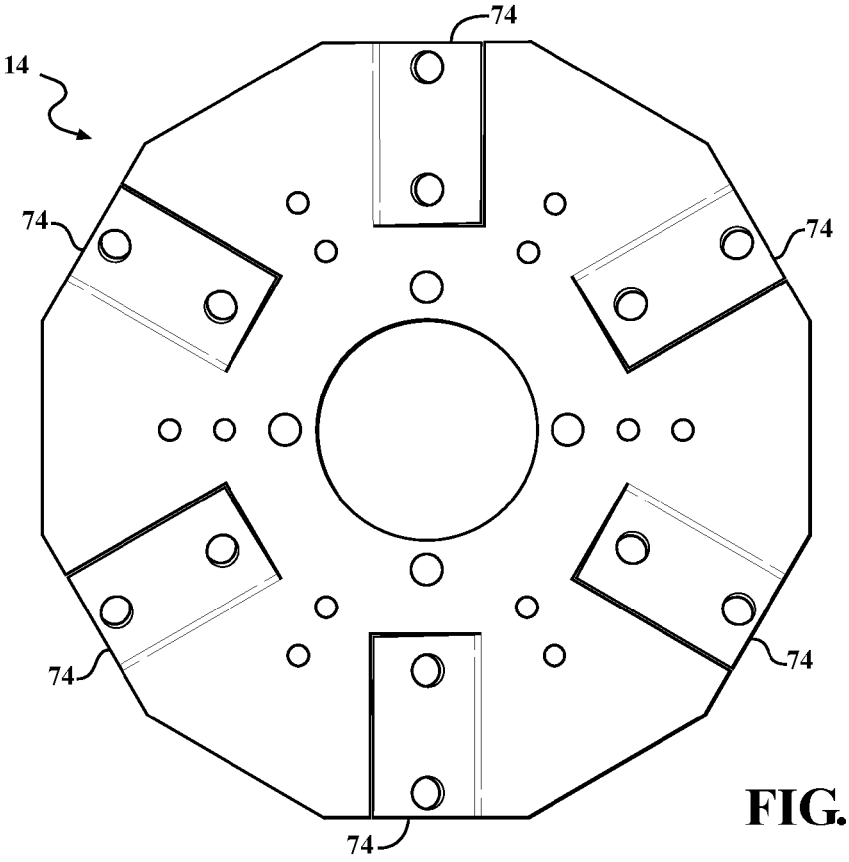
FIG. 8 is a top view of a central hub of the HVLS fan system.
Figure 9:
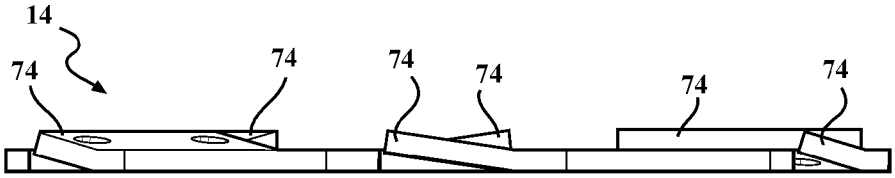
FIG. 9 is a side view of the central hub of FIG. 8.
Figure 10:
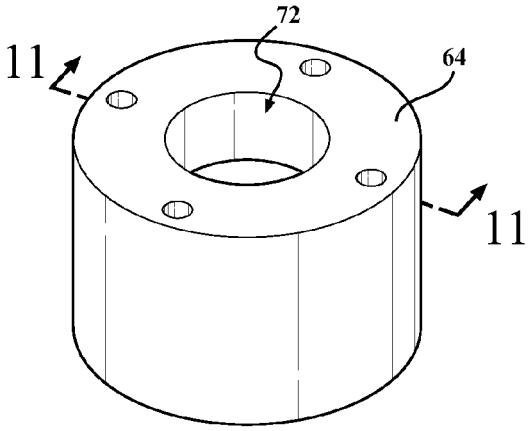
FIG. 10 is a perspective view of a cylinder of the HVLS fan system.
Figure 11:
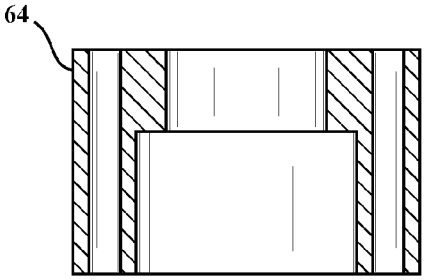
FIG. 11 is a cross-sectional view of the cylinder of FIG. 11.
Figure 12:
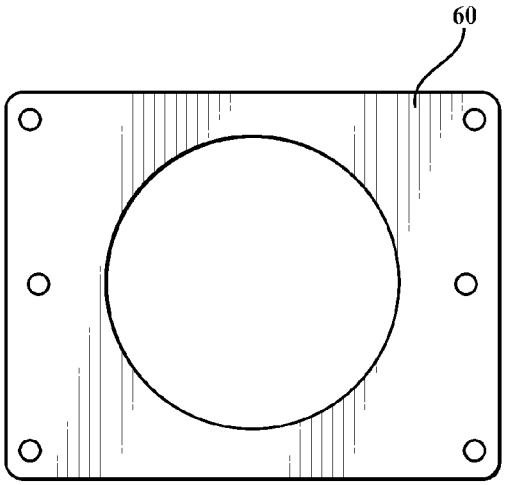
FIG. 12 is a top view of a securing plate of the HVLS fan system.
Figure 13:
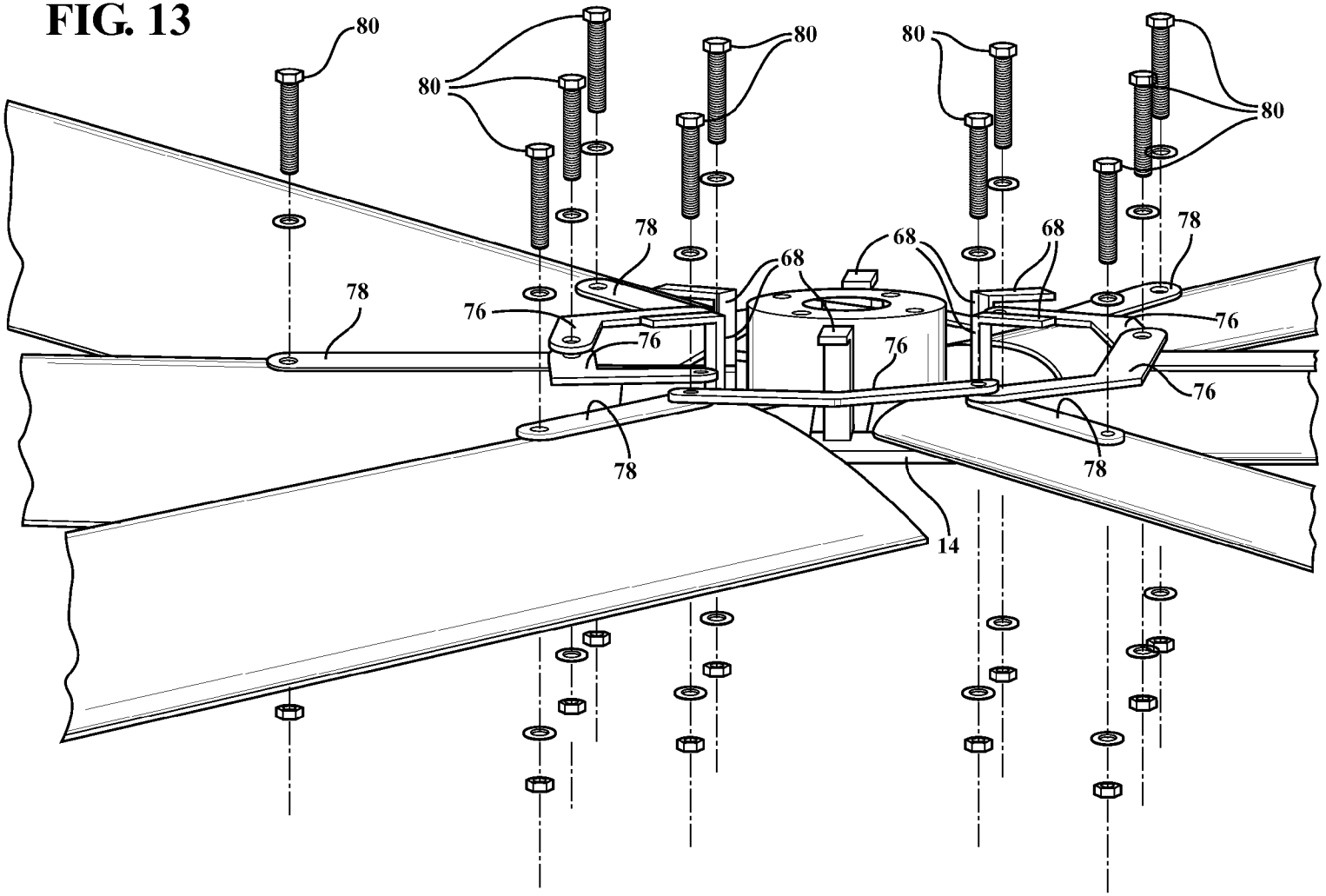
FIG. 13 is a perspective view a of portion of the HVLS fan system in spaced apart form emphasizing the locations of safety brackets.

Referring to FIGS. 1-13, an HVLS fan system 10 of the disclosure includes airfoils 12 coupled at one end to a central hub 14 and extending in the other direction to a distal end having a wingtip fence 16. The central hub 14 is coupled to a motor 18 for rotating the airfoils 12. The motor 18 is connected to a frame 20 which is coupled to a lower yoke 22 and an extension bar 24 which in turn is coupled to an upper yoke 26. The upper yoke 26 is illustrated as connected to a building member 28 such as a girder or other similar structures suitable for bearing the weight of the HVLS fan system. The extension bar 24 as a backup secures the HVLS fan system to the building member 28 with a safety cable 30. Guy wires (not shown) are also used to secure the frame to weight bearing locations on either the builder member 28 or other support structure in the ceiling of the building. Typically, four guy wires are used and attached at somewhat equally spaced locations around the HVLS fan system.

As illustrated, the HVLS fan system has six airfoils 12 equally spaced around the central hub 14. The HVLS fan system airfoils 12 are generally positioned between ten feet and fifty feet above the floor with optimum height generally between twenty feet and thirty feet. The motor 18 is a standard approximately one horsepower electric motor known to those skilled in the art. To accomplish the objective of HVLS, the airfoils 12 are each between five and twelve feet in length and more preferably between six and ten feet in length. Looking up at an installed HVLS fan system 10 it will rotate in a counterclockwise direction 32.

The airfoils 12 are formed out of a lightweight material such as aluminum or a composite metal that can be formed into an airplane wing type shape with a hollow core. However, it should be appreciated that the airfoils can be formed of a variety of different materials, including plastics, polyurethanes, and other suitably rigid materials adequate to form an airfoil, or even combinations of such materials known to those skilled in the art. It should also be appreciated that the length of the airfoils 12 can be increased or decreased to suit a certain application. In addition, it should be appreciated that the HVLS fan system 10 can include airfoils 12 without inclusion of wingtips fences 16. Further, motor 18 may be any manner of other suitable motor including suitable horse power or amperage rating know to those skilled in the art.

The airfoils 12 are fan blades comprised of a generally elliptical top surface 34 and a generally elliptical bottom surface 36. The airfoils 12 are configured to mount to the central hub 14 through the use of an H-shaped connector member 37, connected on one end to the central hub 14 and on the other end to a receptors 39 interior to the airfoil 12. The airfoil further includes a leading edge 38 and a trailing edge 40. The trailing edge 40 maintains a radius of approximately 0.043 inches.

The airfoil may be a substantially hollow extruded aluminum section of approximately 0.1 inches in thickness when mounted to the central hub 14 including STOL-type airfoils. The wingtip fence 16 has a substantially vertical member 42 with a connecting perimeter 44 defined by the profile of the airfoil 12, to which it is attached. The wingtip 16 consisting of a lower concave edge 46, an upper convex edge 48, a leading 50 and trailing edge 52 which sits flush with the airfoil 12 end edge. The vertical member 42 protrudes rearward relative to the leading edge 50 of the airfoil 12. The vertical member 42 consists of two planes. The lower plane is parallel to the connection plane of the airfoil and wingtip fence, while the upper plane is angled outward relative to the innermost end of the airfoil. Adding the wingtip fence 16 to the airfoils 12 improves the aerodynamic properties of the airfoils, by reducing drag and therefore increasing the fan's overall efficiency.

The wingtip fence 16 includes a mounting member 54 which connects to an inner portion of the receptors 39 of the airfoil 12. The wingtip 16 is configured to secure the connection to the airfoil 12 through protruding guide points 56 that couple to an inner perimeter of the airfoil 12 thus mounting the wingtip fence 16 to the airfoil 12.

The central hub 14 provides a securing system for the fan assembly, where a bottom frame member 58 is connected to a securing plate 60 by fasteners 62. The central hub 14 assembly includes a cylinder 64 coupled to the central hub 14 and retaining members 68, one for each of the airfoils 12 that when connected to the central hub 14 extend through an opening in the securing plate 60 thus providing a safety stop against a failure involving a break in the motor 18 or its coupling to the cylinder 64 or a drive shaft 70. The cylinder 64 has an opening 72 for receiving the drive shaft 70. The drive shaft 70 does not connect directly to the cylinder 64, but instead couples to a bushing (not shown) which couples the drive shaft 70 to the cylinder 64 through simultaneous expansion and contraction, as is known to those skilled in the art.

The central hub 14 includes flanges 74 which are displaced from a plane defining the central hub at an angle predetermined for the airfoils 12. The angle of the flanges 74 positions the airfoils 12 at an angle most suitable for maximizing the benefits of the STOL technology. More particularly, this includes an attachment angle of between seven and ten degrees to the airfoil, and even more particularly eight degrees to the airfoil.

Another safety aspect is a series of overlapping brackets including a first bracket 76 and second bracket 78 which mount on the top of the airfoils and interlock each of the airfoils 12 to the one next to it. The first bracket 76 and second bracket 78 are held in place with fasteners 80. This prevents the airfoil 12 from becoming dislodged from the system in the event of failure. In addition, guy wires (not shown) connect the frame of the HVLS fan system to a support member such as a ceiling support beam.

After applicants first conceived that STOL technology would benefit efficiencies and overall performance of an HVLS fan, experimentation was undertaken under preset parameters and requirements to optimize a STOL airfoil profile. This experimentation, undertaken at the request and direction of the applicants by Haiyer Lou, Ph.D, M. Eng at TurboMoni, confirmed that of two airfoil profiles adapting STOL technology an airfoil following EPPLER-420 parameters was more efficient when angled at approximately 8 degrees from horizontal. Thus, referring to FIG. 14, the airfoils 12 are predetermined to comply with STOL technology and provide high efficiency operation including higher lift and lower drag for the application of an HVLS fan. The EPPLER-420 profile disclosed in FIG. 14 provides dimensionless cord lengths that provide for defining X-Y coordinates by multiplying with the real cord (the distance from leading edge point to the trailing edge point).

Thus, an HVLS fan system of the invention, including its various embodiments, provides a high efficiency cost effective, secure means of addressing and providing air movement in large open areas.

While particular embodiments of the invention have been shown and described, numerous variations and alternative embodiments will occur to those skilled in the art. Accordingly, it is intended that the invention be limited only in terms of the appended claims.

What is claimed is:

1. A high volume low speed fan system, comprising:

a plurality of airfoils each having a generally elliptical top surface, a leading edge and a generally elliptical bottom surface wherein each airfoil is mounted to a flange on a central hub;

a motor attached to a frame member wherein the motor is coupled to a drive mechanism for rotating the airfoils wherein the drive mechanism is rotatably coupled to the central hub; and a wingtip fence attached to a distal end of the airfoils for reducing drag of the airfoils having a vertical member that extends from a mid-section of the fan blade rearwardly and a forward portion that attaches substantially flush with the fan blade, and a vertical flap extending above the top surface of each of the airfoils wherein the vertical flap has a lower flap extending vertically below the bottom surface of each of the airfoils and rearwardly away from said leading edge commencing approximately at the widest portion of the fan blade.

2. The high volume low speed fan system of claim 1, wherein the flange is angled at 8 degrees from horizontal.

3. The high volume low speed fan system of claim 1, further comprising:

a plurality of retaining members coupled to the central hub each passing through an opening of a safety frame coupled to the frame member wherein the retaining members pass through the opening of the safety frame without contacting the safety frame or the frame member wherein operational separation of the drive mechanism from the central hub does not result in separation of the central hub from the safety frame.

4. A high volume low speed fan system, comprising:

a plurality of airfoils each having a generally elliptical top surface, a leading edge and a generally elliptical bottom surface wherein each airfoil is mounted to a flange on a central hub;

a motor attached to a frame member wherein the motor is coupled to a drive mechanism for rotating the airfoils wherein the drive mechanism is rotatably coupled to the central hub; and a wingtip fence attached to a distal end of the airfoils for reducing drag of the airfoils having a vertical member that extends from a mid-section of the fan blade rearwardly and a forward portion that attaches substantially flush with the fan blade, and a vertical flap extending below the bottom surface of each of the airfoils wherein the vertical flap is generally angled outwardly from the central hub and rearwardly away from said leading edge commencing approximately at the widest portion of the fan blade.

5. The high volume low speed fan system of claim 4, wherein the flange is angled between 8 and 9 degrees from horizontal.

6. The high volume low speed fan system of claim 4, further comprising:

a plurality of retaining members coupled to the central hub each passing through an opening of a safety frame coupled to the frame member wherein the retaining members pass through the opening of the safety frame without contacting the safety frame or the frame member wherein operational separation of the drive mechanism from the central hub does not result in separation of the central hub from the safety frame.

7. A high volume low speed fan system, comprising:

a plurality of airfoils each having a generally elliptical top surface, a leading edge and a generally elliptical bottom surface wherein each airfoil is mounted to a flange on a central hub;

a motor attached to a frame member wherein the motor is coupled to a drive mechanism for rotating the airfoils wherein the drive mechanism is rotatably coupled to the central hub; and a wingtip fence attached to a distal end of the airfoils for reducing drag of the airfoils having a vertical flap extending above the top surface of each of the airfoils and s a lower flap extending vertically below the bottom surface of each of the airfoils and rearwardly away from said leading edge commencing approximately at the widest portion of the fan blade.

8. The high volume low speed fan system of claim 7, wherein the flange is angled between 8 and 9 degrees from horizontal.

9. The high volume low speed fan system of claim 7, wherein the flange is angled at 8 degrees from horizontal.

10. The high volume low speed fan system of claim 7, further comprising:

a plurality of retaining members coupled to the central hub each passing through an opening of a safety frame coupled to the frame member wherein the retaining members pass through the opening of the safety frame without contacting the safety frame or the frame member wherein operational separation of the drive mechanism from the central hub does not result in separation of the central hub from the safety frame.

* * * * *

UNITED STATES PATENT AND TRADEMARK OFFICE

CERTIFICATE OF CORRECTION

PATENT NO. : 9,011,099 B2
APPLICATION NO. : 13/835359
DATED : April 21, 2015
INVENTOR(S) : Wortman et al.

It is certified that error appears in the above-identified patent and that said Letters Patent is hereby corrected as shown below:

In the claims

Column 6 Line 38 Claim 7: delete “and s a lower” and insert --and a lower--

Signed and Sealed this
Seventeenth Day of November, 2015

Michelle K. Lee

Michelle K. Lee
*Director of the United States Patent and Trademark Office*